US007063160B2

(12) United States Patent
Fenton et al.

(10) Patent No.: US 7,063,160 B2
(45) Date of Patent: Jun. 20, 2006

(54) NON-ORIENTING TUBING HANGER SYSTEM WITH A FLOW CAGE

(75) Inventors: Stephen Paul Fenton, Houston, TX (US); Robert N. Rogers, Katy, TX (US); Jon E. Hed, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 223 days.

(21) Appl. No.: 10/627,853

(22) Filed: Jul. 25, 2003

(65) Prior Publication Data

US 2004/0159439 A1 Aug. 19, 2004

Related U.S. Application Data

(60) Provisional application No. 60/399,478, filed on Jul. 30, 2002.

(51) Int. Cl.
*E21B 43/12* (2006.01)
*E21B 33/03* (2006.01)

(52) U.S. Cl. ..... 166/369; 166/89.1; 166/368

(58) Field of Classification Search ..... 166/368, 166/369, 382, 75.11, 88.1, 89.1, 75.13, 75.14
See application file for complete search history.

(56) References Cited

U.S. PATENT DOCUMENTS 2,086,431 A * 7/1937 Penick et al. ..... 285/123.9
2,188,557 A * 1/1940 Otis ..... 166/88.1
3,087,547 A * 4/1963 Raulins et al. ..... 166/89.1
3,478,822 A * 11/1969 Holbert, Jr. et al. ..... 166/88.1
5,080,174 A * 1/1992 Hynes ..... 166/382
5,213,162 A 5/1993 Iato
5,544,707 A * 8/1996 Hopper et al. ..... 166/382
5,555,935 A * 9/1996 Brammer et al. ..... 166/88.1
5,865,250 A * 2/1999 Gariepy ..... 166/375
5,941,310 A * 8/1999 Cunningham et al. ..... 166/345
5,988,282 A * 11/1999 Jennings et al. ..... 166/348
6,062,314 A * 5/2000 Nobileau ..... 166/368
6,119,773 A * 9/2000 Gariepy et al. ..... 166/88.1
6,470,968 B1 * 10/2002 Turner ..... 166/348
6,508,308 B1 * 1/2003 Shaw ..... 166/313
6,557,629 B1 * 5/2003 Wong et al. ..... 166/76.1
6,612,368 B1 * 9/2003 Kent et al. ..... 166/75.13
6,782,949 B1 * 8/2004 Cove et al. ..... 166/368
6,871,708 B1 * 3/2005 Calder et al. ..... 166/348
2002/0029887 A1 * 3/2002 Baskett et al. ..... 166/368
2002/0117298 A1 * 8/2002 Wong et al. ..... 166/86.1
2002/0117305 A1 * 8/2002 Calder et al. ..... 166/358
2003/0121667 A1 * 7/2003 Massie et al. ..... 166/344
2003/0141072 A1 * 7/2003 Cove et al. ..... 166/368

* cited by examiner

*Primary Examiner*—Jennifer H. Gay
(74) *Attorney, Agent, or Firm*—Bracewell & Giuliani LLP

(57) ABSTRACT

In a subsea wellhead assembly, a tubing hanger in communication with the subsea well has a hanger port extending through its side. A diverter surrounds the tubing hanger and diverts well fluid transmitted from the hanger port around a portion of the tubing hanger. The diverter transmits the well fluid to the inner surface of a wellhead member. A production port extending through a side of the wellhead member transmits the well fluid from the tubing hanger and diverter to an exterior of the wellhead member.

19 Claims, 5 Drawing Sheets

NON-ORIENTING TUBING HANGER SYSTEM WITH A FLOW CAGE

RELATED APPLICATIONS

Applicants claim priority to the invention described herein through a United States provisional patent application titled "Non-Orienting Tubing Hanger System with a Flow Cage," having U.S. Patent Application Ser. No. 60/399,478, which was filed on Jul. 30, 2002, and which is incorporated herein by reference in its entirety.

BACKGROUND OF THE INVENTION

1. Field of the Invention

The present invention relates generally to production well systems, more specifically to assemblies and methods for achieving installation of a hanger in such systems.

2. Background of the Invention

Well fluid from a subsea well typically flows up a string of production tubing to a subsea wellhead. Sometimes well fluid is transmitted through a production riser to a Christmas tree on a vessel at the surface of the sea. It is often desirous however to transport the well fluid through a subsea Christmas tree to a collection facility or processing site.

In one type of subsea tree, the production tubing is suspended on a tubing hanger landed in a wellhead housing. The tree mounts to the wellhead housing and the tubing hanger has an axial through-bore to deliver fluid to the tree. The tubing hanger also has an annulus passage extending through it for communicating with the tubing annulus.

In another type, the tubing hanger lands in the tree, which is supported on the wellhead housing. The tubing hanger has a lateral port extending from it that aligns a lateral port in the tree.

In both of these types, the tubing hanger must be oriented, which can be complex in deep water. Also both types require relatively large diameters. To reduce expense, smaller diameter wells and components are desirable. Concentric tubing hangers do not require orientation. However, they typically require check valves for the annulus, thus historically are not used extensively.

SUMMARY OF THE INVENTION

In the subsea wellhead assembly of this invention, a tubular wellhead member or wellhead housing, which may be considered a tree, has a production port extending through its side for transmitting production fluid or well fluid from the subsea well. The tubing hanger lands in a bore of the wellhead housing and has an inner bore in fluid communication with the string of tubing. The tubing hanger conveys production fluid from the string of tubing to a production port. The production fluid flows through a hanger port extending through a side of the tubing hanger from the bore of the tubing hanger to the production port extending. A diverter or flow cage is positioned adjacent the tubing hanger for diverting the flow of production fluid from the hanger port around a portion of the tubing hanger to the production port. The hanger port can be a plurality of ports extending through a radial portion of the tubing hanger.

The well fluid contacts the inner surface of the diverter or flow cage after flowing out of the tubing hanger. The diverter can surround the exterior surface of the tubing hanger so that the well fluid flows around a portion of the tubing hanger. The diverter can also include a port or a plurality of ports extending through a radial portion of the diverter that is offset from hanger port for the production fluid to flow from inside the diverter to the interior surface of the wellhead housing. The well fluid then flows between the outer surface of the diverter and the inner surface of the wellhead member to the production port.

The tubing hanger has one or more tubing annulus ports extending axially through it. Control of the tubing annulus is controlled by a controls cap mounted above the tubing hanger.

DETAILED DESCRIPTION OF THE PREFERRED EMBODIMENT

Figure 1:
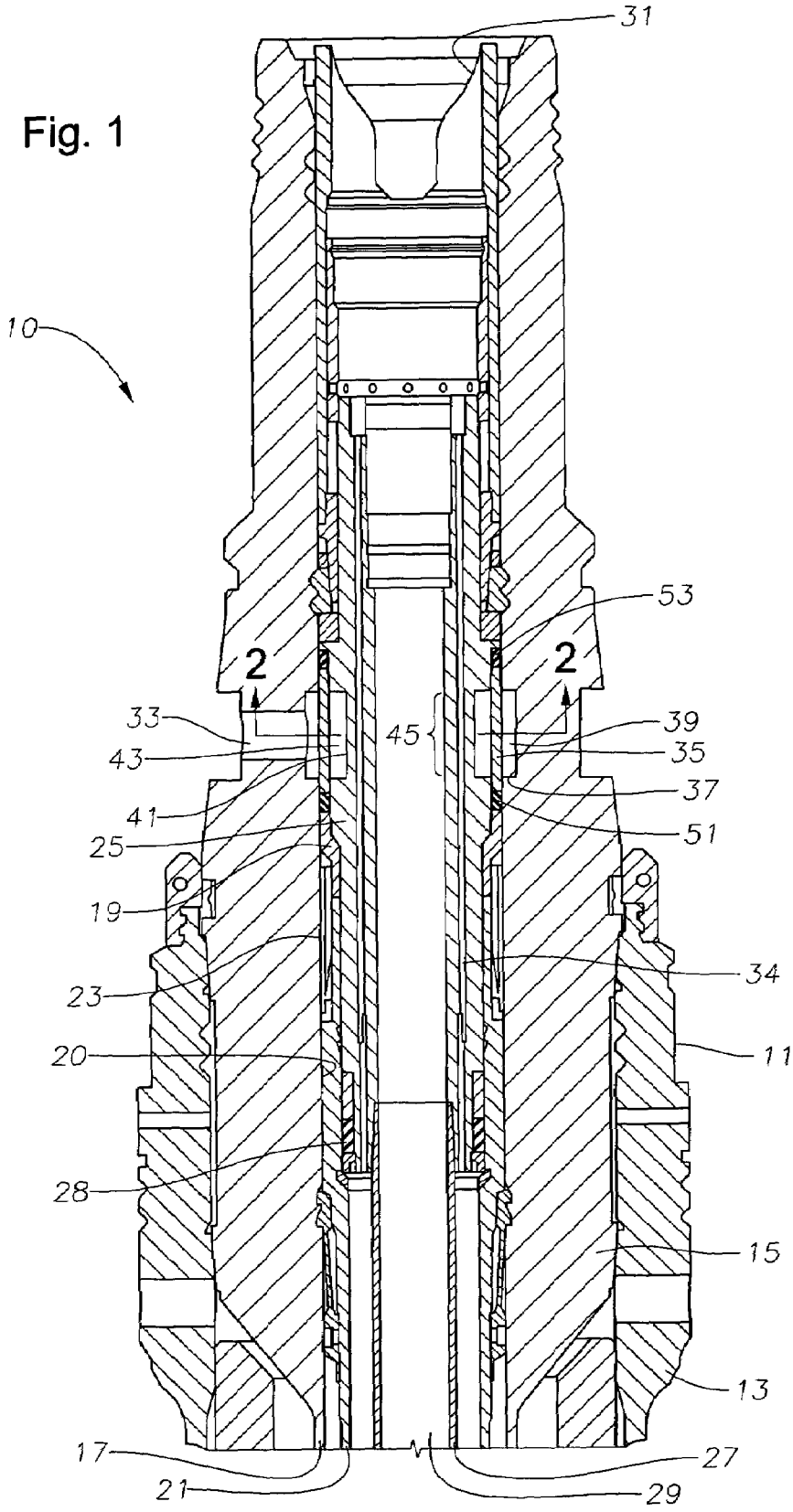
FIG. 1 is an overall sectional view of an upper portion of a non-orienting tubing hanger placed in a wellhead assembly, each being constructed in accordance with this invention.

Referring to FIG. 1, one configuration for a subsea wellhead assembly 10 includes a low pressure wellhead housing or conductor housing 11, which will locate at the sea floor. Low pressure wellhead housing 11 is a large tubular member that is secured to a string of conductor pipe 13. Conductor pipe 13 extends to a first depth into the well.

A high pressure wellhead member 15 lands in the low pressure wellhead housing 11. Wellhead member 15 functions both as a wellhead housing and a production tree. High pressure wellhead member 15 secures to a first string of casing 17, which extends through the conductor pipe 13 to a deeper depth into the well. Normally, the first string of casing 17 is cemented in place. A casing hanger 19 and casing 21 are installed in high pressure wellhead member 15 within first string of casing 17, and string of casing 21 is typically cemented into place. Casing hanger 19 lands on a lower shoulder in the interior surface of high pressure wellhead member 15. Casing hanger 19 is sealed by a casing hanger packoff 23 to interior surface 20 of high pressure wellhead member 15.

A tubing hanger 25 having an interior surface and an exterior surface lands on a shoulder on casing hanger 19. Tubing hanger 25 is sealed by a hanger packoff 28 to interior surface 20 of casing hanger 19. Tubing hanger 25 secures to tubing 27. Tubing 27 extends through string of casing 21 to a desired depth of the well. Tubing 27 is not cemented in place. Tubing 27 defines a production passageway 29 through which production fluids communicate from the well to wellhead assembly 10 before exiting to a production flowline (not shown).

A bore 31 is formed in wellhead member 15 above tubing hanger 25 for receiving a controls cap (not shown) that provides a barrier and has valves or plugs for controlling entry into production passageway 29 and access to the tubing annulus. A stringer (not shown) extends from the controls cap into production passageway 29. A wire line plug (not shown) will typically be set in the upper end of tubing hanger passage 29. A production port 33 in high pressure wellhead member 15 above conductor housing 11 extends radially from inner surface 20 of high pressure wellhead member 15 to the outer surface of high pressure wellhead member 15. A pair of tubing annulus passages 34 extend axially through hanger 25 for access to the annulus surrounding tubing 27. An outer cage 35 is formed on the outer surface of tubing hanger 25, which engages the upper end of casing hanger 19 when tubing hanger 25 lands in the well. Outer cage 35 is in fluid communication with production port 33 when tubing hanger 25 lands in the well.

Figure 5:
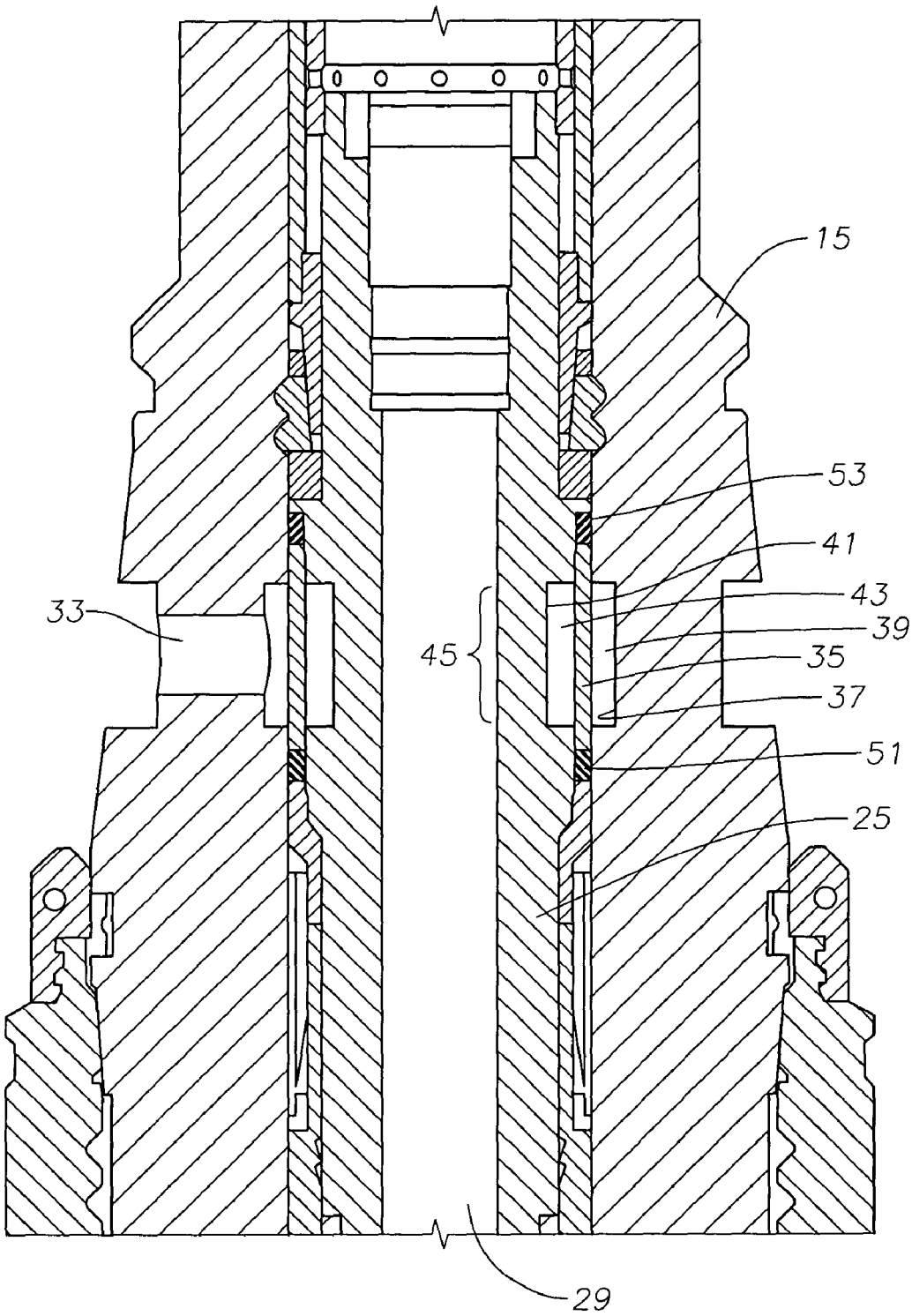
FIG. 5 is an enlarged cross-sectional view of the upper portion of a non-orienting tubing hanger taken along the line 5—5 of FIG. 2 when placed in the wellhead assembly as shown in FIG. 1.

As illustrated in FIGS. 1 and 5, a housing recess 37 is formed around the inner circumference of high pressure wellhead member 15. Housing recess 37 and the outer surface of outer cage 35 define an outer chamber 39 that is in fluid communication with production port 33. A casing recess 41 is formed around the outer circumference of tubing hanger 25. Casing recess 41 and the inner surface of outer cage 35 define an inner chamber 43, which is substantially parallel with outer chamber 39. Inner chamber 43 defines an inner cage 45 as the region or portion of tubing hanger 25 that is surrounded by inner chamber 43.

Figure 2:
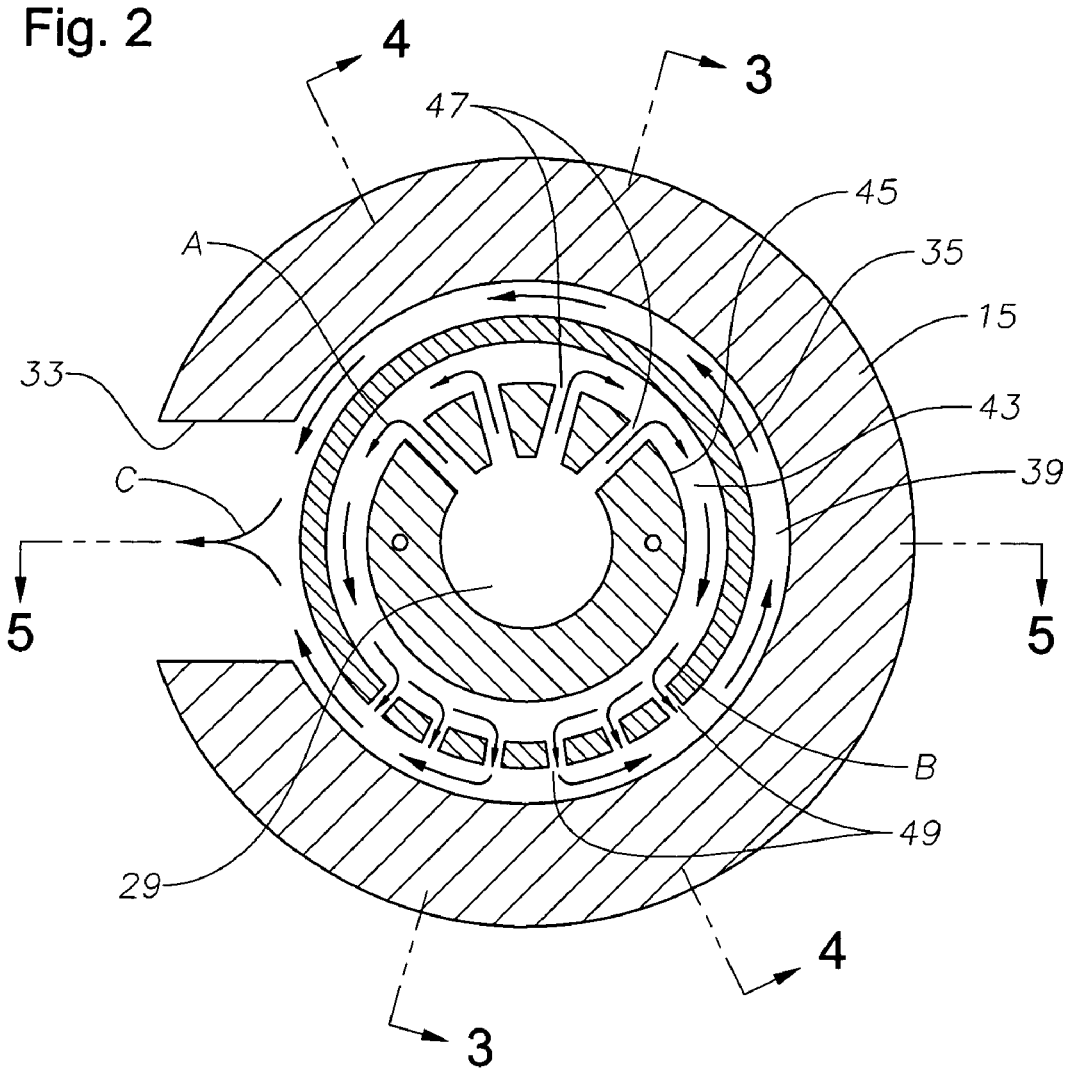
FIG. 2 is a cross-sectional view of the tubing hanger shown in FIG. 1 and taken along the line 2—2 of FIG. 1.
Figure 3:
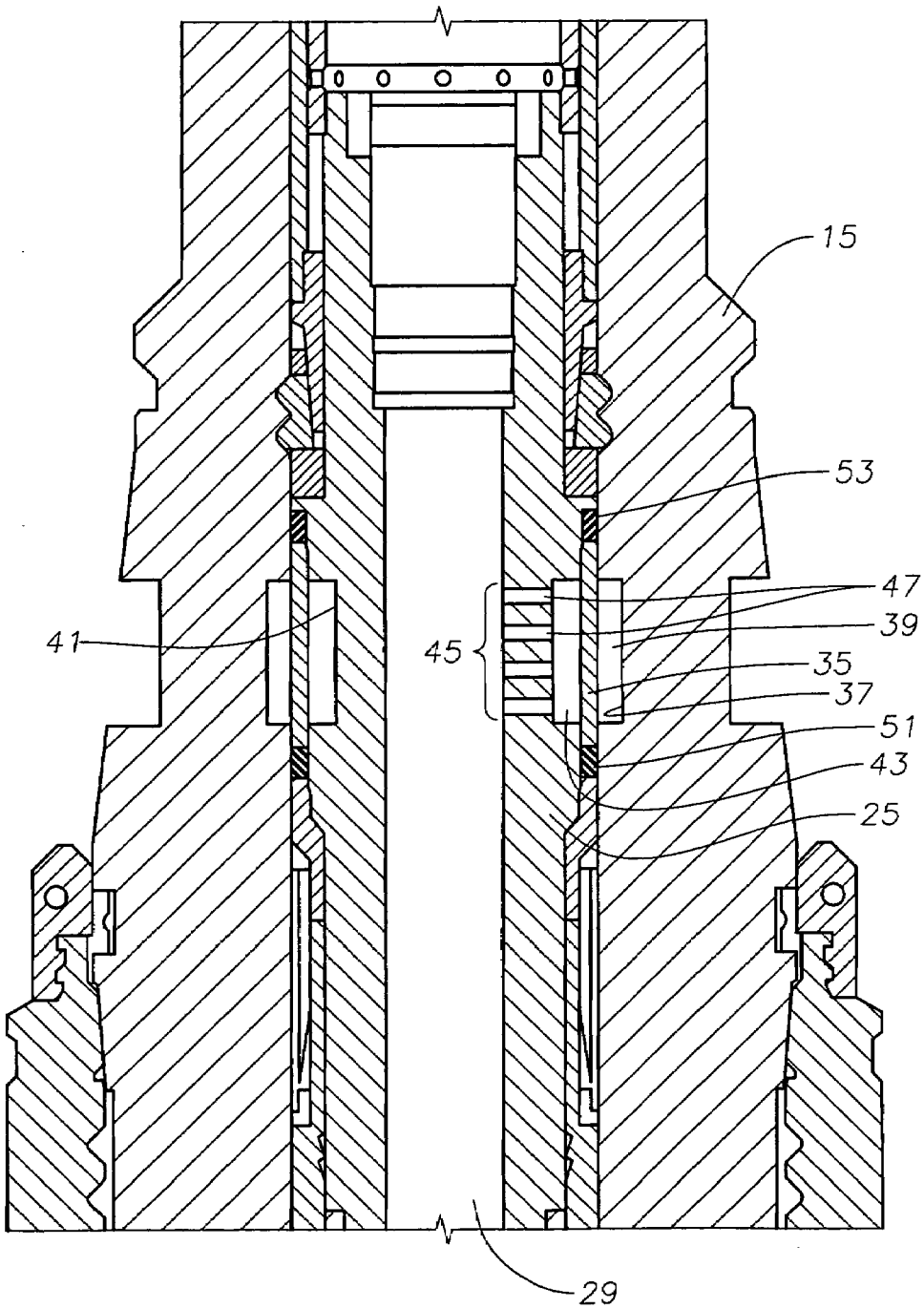
FIG. 3 is an enlarged cross-sectional view of the upper portion of a non-orienting tubing hanger taken along the line 3—3 of FIG. 2 when placed in the wellhead assembly as shown in FIG. 1.

As illustrated in FIGS. 2 and 3, at least one hanger port or radial opening 47 is formed in inner cage 45. Preferably there are a plurality of radial openings 47 along inner cage 45. Inner chamber 43 is in fluid communication with passageway 29 through openings 47. Openings 47 transmit production fluid from passageway 29 into inner chamber 43. Typically openings 47 are formed intermittently along a radial portion that is less than one-half of the circumference of inner cage 45.

Figure 4:
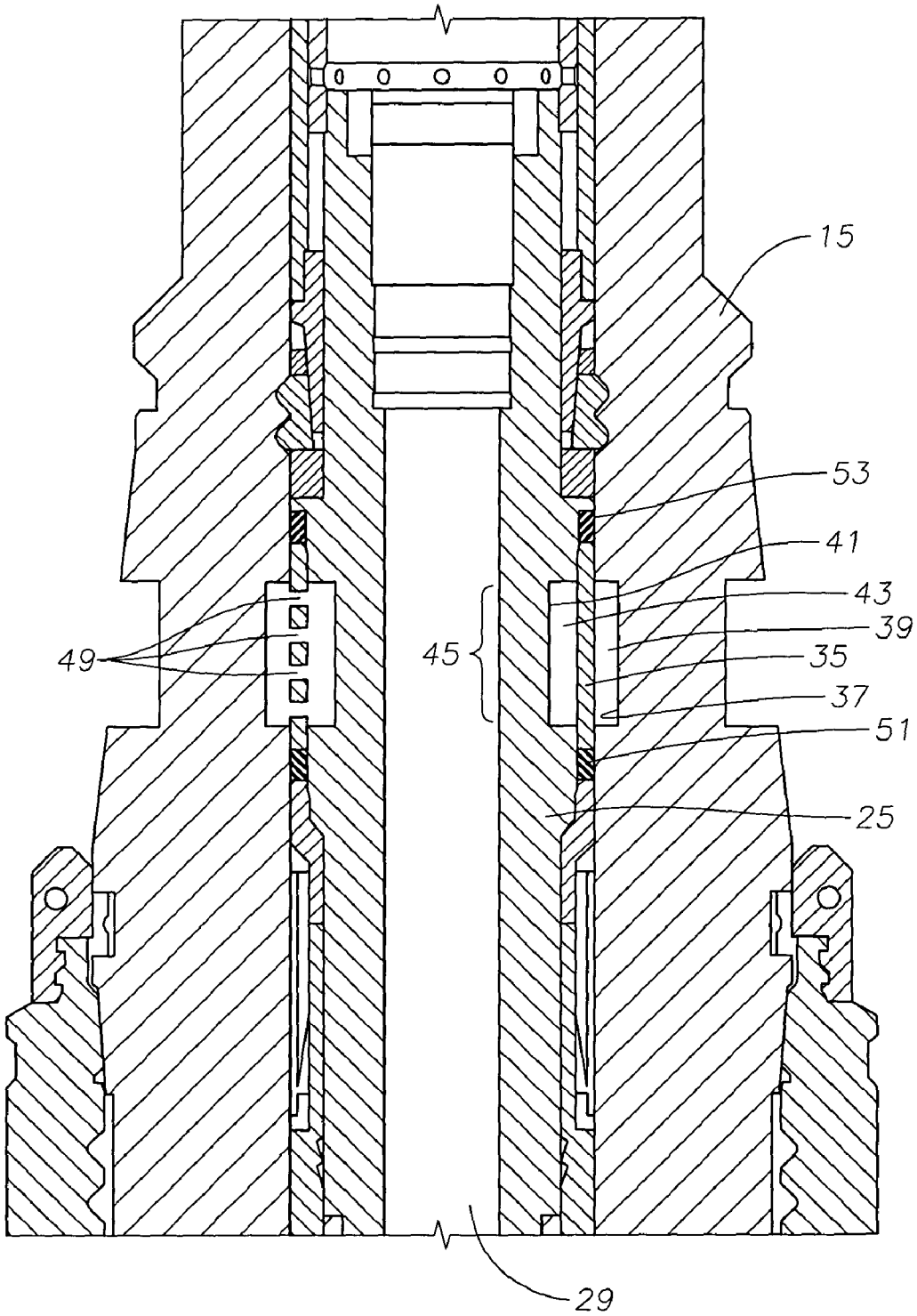
FIG. 4 is an enlarged cross-sectional view of the upper portion of a non-orienting tubing hanger taken along the line 4—4 of FIG. 2 when placed in the wellhead assembly as shown in FIG. 1.

At least one diverter port or radial opening 49 is formed in outer cage 35. Preferably there are a plurality of radial openings 49 along outer cage 35 (as shown in FIGS. 2 and 4). Outer chamber 39 is in fluid communication with inner chamber 43 through openings 49. Openings 47 transmit production fluid from passageway 29 into inner chamber 43, from which openings 49 transmit production fluid to outer chamber 39. Typically openings 49 are formed intermittently along a radial portion that is less than one-half of the circumference of outer cage 35. Preferably there are no openings 49 formed in the radial portion of outer cage 35 surrounding the radial portion of inner cage 45 where openings 47 are formed. Production fluid must flow through inner chamber 43, around a portion of inner cage 45, and through openings 49 on the opposite radial portion of outer cage 35.

There is no need for aligning openings 49 with production port 33. Typically, openings 49 will be misaligned with production port 33 when landed. With openings 49 facing a solid portion of high pressure wellhead member 15, rather than production port 33, the production fluid must communicate through outer chamber 39 around some portion of outer cage 35 to production port 33. The combination of inner chamber 43 and outer chamber 39 allows tubing hanger 25 to land facing any direction.

Seals 51 and 53 (FIG. 1), located above and below outer cage 35 sealingly engage the inner surface of high pressure wellhead member 15 when tubing hanger 25 lands in high pressure wellhead member 15. Seals 51 and 53 block the flow of production fluid from outer chamber 39 above and below tubing hanger 25. Production port 33 communicates production fluid exiting from tubing hanger 25 to a flowline or pipeline (not shown) that carries the production fluids away from wellhead assembly 10. Production valves (not shown) are mounted to the exterior of wellhead member 15 for controlling well fluid flow.

In operation, the well is drilled and cased as shown in FIG. 1. To do so, conductor housing 11, with a string of conductor pipe 13, is landed and cemented into the well to a certain depth. High pressure wellhead member 15, with first string of casing 17 extending from high pressure wellhead member 15, is then landed and cemented into the well at a deeper depth. A casing hanger 19 with casing 21 is then landed and cemented into the well. Hanger packoff 23 sealingly engages hanger 19 with inner surface 20 of high pressure wellhead member 15.

Tubing hanger 25, with tubing 27 extending down to production depth, is landed to complete the well. Hanger packoff 28 sealingly connects tubing hanger 25 to inner surface 20 of casing hanger 19. Outer cage 35 lands straddling production port 33 and housing recess 37 of high pressure wellhead member 15. Typically, openings 49 will not open directly to the opening to production port 33 because tubing hanger 25 is not oriented as it is landed. Seals 51 and 53 sealingly engage the outer surface of tubing hanger 25, above and below outer cage 35 and housing recess 37, to inner surface 20 of high pressure wellhead member 15.

A controls cap is mounted to wellhead member 15 above tubing hanger 25. After valves (not shown) and flow lines (not shown) are connected to production ports 33, the operator can remotely actuate the production valves so that production fluid entering the well below may flow or be pumped up passageway 29 in tubing 27 towards wellhead assembly 10. Because bore 31 at the top of wellhead assembly is capped by the controls cap, the production fluid must exit passageway through openings 47. The total area of openings 47 is greater than the area of passageway 29. Therefore, as the production fluid passes through openings 47 to inner chamber 43, as designated by arrow A in FIG. 2, the velocity of the production fluid traveling through each opening 47 is less than the velocity of the production fluid before reaching openings 47.

The production fluid must flow through inner chamber 43, around a radial portion of inner cage 45 on its way towards openings 49. The production fluid flows through openings 49 into outer chamber 39, as designated by arrows B in FIG. 2. Typically, the total area of openings 49 is larger than the area of passageway 29. Therefore, the production fluid has a smaller velocity through each opening 49 than the velocity of the production fluid before entering openings 47 toward inner chamber 43. Having production fluid contacting the inner surface of wellhead member 15 with a reduced velocity reduces tendency for wear on wellhead member 15.

The production fluid flows through outer chamber 39, typically around a radial portion of outer cage 35 on its way toward production port 33, as designated by arrows C, because openings 49 will typically land oriented away from the opening to production port 33. Seals 51 and 53 prevent the production fluid from exiting outer chamber 39 until the production fluid flows to production port 33. Preferably, the opening to production port 33 has a larger area than the area of passageway 29. Therefore, the production fluid velocity through production port 33 is less than the velocity in passageway 29. The production fluid communicates from production port 33 to a production flowline (not shown) or to a riser (not shown), which carries the production fluid to a platform for processing.

Diverting the production fluid through inner chamber 43 before the fluid contacts the inner surface of high pressure wellhead member 15 reduces the erosion that may be experienced due to production flow under extreme service conditions. Inner cage 45 and outer cage 39 act together to reduce the velocity of the production fluid when it initially engages high pressure wellhead member 15. Inner and outer cages 45 and 39 are maintainable parts within tubing hanger 25. Wear on the wellhead member 15 can be minimized by using inner and outer cages 45 and 39 in tubing hanger 25 to engage the production fluid at higher velocities, and to reduce the velocity of the production fluid.

The production fluid passes through openings 47 and encounters the inner surface of outer cage 45 before engaging high pressure wellhead member 15. Openings 47 do not have to be oriented in any particular direction relative to production port 33 to achieve this benefit. Accordingly, operator does not have to employ an orienting system to automatically guide tubing hanger 25 as it lands in high pressure wellhead member 15. As discussed above, the reduced velocity of the production fluid engaging wellhead member 15 from openings 49 allows for tubing hanger 25 landings where openings 49 do not open directly to the opening of production port 33.

While the invention has been shown in only one of its forms, it should be apparent to those skilled in the art that it is not so limited, but is susceptible to various changes without departing from the scope of the invention. For example, the size of the openings in the inner cage, outer cage, and production port could vary to create differing production fluid velocities at the different stages the production fluid communicates through. Similarly, while the tubing hanger is shown inside the wellhead, it may equally be applied inside a tubing head spool.

That claimed is:

1. A subsea wellhead assembly, comprising:

a tubular wellhead member;

a production port extending through a side of the wellhead member for transmitting production fluid from the subsea well;

a tubing hanger, having a string of tubing extending to a production depth within the subsea well, that lands in a bore of the wellhead member and has an inner bore in fluid communication with the string of tubing;

at least one hanger port extending through a side of the tubing hanger for transmitting the production fluid from the bore of the tubing hanger to the production port;

a diverter positioned adjacent the tubing hanger for diverting the flow of production fluid from the hanger port around a portion of the tubing hanger to the production port, the diverter having a tubular cross-section and surrounding a portion of the outer surface of the tubing hanger; and a diverter port that is located at a substantially opposite circumferential position from the hanger port.

2. The subsea wellhead assembly of claim 1, wherein said at least one hanger port comprises a plurality of hanger ports.

3. The subsea wellhead assembly of claim 1, wherein the hanger port extends through a portion of the tubing hanger at an axial position substantially the same as the production port.

4. The subsea wellhead assembly of claim 1, wherein the diverter port extends through a portion of the diverter at an axial position substantially the same as the production port.

5. The subsea wellhead assembly of claim 1, further comprising a tubing annulus passage extending axially through the tubing hanger.

6. A subsea wellhead assembly, comprising:

a tubular wellhead member;

a production port extending through a side of the wellhead member for transmitting production fluid from the subsea well;

a tubing hanger, having a string of tubing extending to a production depth within the subsea well, that lands in a bore of the wellhead member and has an inner bore in fluid communication with the string of tubing;

at least one hanger port extending through a side of the tubing hanger for transmitting production fluid from the bore of the tubing hanger to the production port;

a diverter positioned adjacent the hanger port for diverting the flow of production fluid from the hanger port; and at least one diverter port spaced circumferentially from the hanger port for transmitting the production fluid from the hanger port to an outer surface of the diverter, the diverter port being spaced radially outward from the hanger port and radially inward from the production port wherein flow of production fluid is diverted circumferentially around at least a portion of the tubing hanger to the at least one diverter port.

7. The subsea wellhead assembly of claim 6, wherein said at least one hanger port comprises a plurality of hanger ports.

8. The subsea wellhead assembly of claim 6, wherein the hanger port extends through a portion of the tubing hanger at an axial position substantially the same as the production port.

9. The subsea wellhead assembly of claim 6, wherein the diverter has a tubular cross-section and surrounds a portion of the outer surface of the tubing hanger, and wherein the wellhead assembly further comprises upper and lower seals between the diverter and the wellhead member above and below the diverter port.

10. The subsea wellhead assembly of claim 6, wherein said at least one diverter port comprises a plurality of diverter ports.

11. The subsea wellhead assembly of claim 6, wherein the diverter port extends through a portion a substantially opposite circumferential position from the hanger port so that the production fluid flows around substantially half the circumference of the tubing hanger.

12. The subsea wellhead assembly of claim 6, wherein the hanger port defines a hanger port cross-sectional area, and the bore of the tubing hanger defines a tubing hanger cross-sectional area, and wherein the hanger port cross-sectional area is greater than the tubing hanger cross-sectional area so that a velocity of the production fluid decreases while passing through hanger port.

13. The subsea wellhead assembly of claim 6, wherein the hanger port defines a hanger port cross-sectional area, and the diverter port defines a diverter cross-sectional area, and wherein the diverter cross-sectional area is greater than the hanger port cross-sectional area so that a velocity of the production fluid decreases while passing through diverter port.

14. The subsea wellhead assembly of claim 6, further comprising an annular recess on an outer diameter of the tubing hanger, the hanger port being located in the recess; and an annular recess in the bore of the wellhead member, the production port being located in the annular recess of the wellhead member.

15. A tubing hanger and production tubing assembly for a subsea well, comprising:

a tubing hanger member adapted to land in a bore of a wellhead housing of a subsea well;

a string of production tubing that hangs from the tubing hanger so that an interior of the tubing hanger is in fluid communication with a bore of the tubing hanger, the string of production tubing being adapted to extend to a production depth within the subsea well when the tubing hanger lands in the wellhead housing;

at least one hanger port extending through a side of the tubing hanger member for transmitting production fluid from the bore of the tubing hanger member to an outer surface of the tubing hanger member;

a diverter cage positioned around the tubing hanger at the hanger port, the diverter cage having an inner diameter greater than an outer diameter of the tubing hanger at the hanger port, defining an annular chamber, causing well fluid to flow into the annular chamber; and at least one diverter port spaced circumferentially from the hanger port for transmitting the production fluid from the annular chamber to an outer surface of the diverter wherein flow of production fluid flows through the annular chamber around at least a portion of the tubing hanger to the at least one diverter port.

16. The tubing hanger and production tubing assembly of claim 15, wherein said at least one hanger comprises a plurality of hanger ports.

17. A method for conveying production fluid from a subsea well, comprising:

landing a tubing hanger member, with a string of tubing extending therefrom, within a bore of a wellhead member of a subsea wellhead, and providing the tubing hanger member with a hanger port extending through its side and with a diverter located adjacent the port and surrounding a portion of the outer surface of the tubing hanger member, the diverter having a diverter port spaced circumferentially from the hanger port;

transmitting a production fluid from the subsea well from the bore of the tubing hanger member through the hanger port to the outer surface of the tubing hanger member;

with the diverter, diverting the production fluid around the portion of the outer surface of the tubing hanger member; and then transmitting the production fluid through the diverter port to the interior surface of the welihead member for conveyance from the wellhead member.

18. The method of claim 17, further comprising reducing a velocity of the production fluid while transmitting the production fluid out the tubing hanger port of the tubing hanger member.

19. The method of claim 17, further comprising reducing a velocity of the production fluid while transmitting the production fluid through the diverter port to the interior surface of the wellhead member.

* * * * *

UNITED STATES PATENT AND TRADEMARK OFFICE

CERTIFICATE OF CORRECTION

PATENT NO. : 7,063,160 B2
APPLICATION NO. : 10/627853
DATED : June 20, 2006
INVENTOR(S) : Stephen Paul Fenton et al.

It is certified that error appears in the above-identified patent and that said Letters Patent is hereby corrected as shown below:

In the Specification:

Column 1, line 56, delete "extending" after "port"
Column 2, line 1, insert --the-- before "hanger port"

Signed and Sealed this

Twenty-eighth Day of November, 2006

JON W. DUDAS
*Director of the United States Patent and Trademark Office*